US005130193A

United States Patent [19]

Ikeda

[11] Patent Number: 5,130,193

[45] Date of Patent: Jul. 14, 1992

[54] FIBER-REINFORCED COMPOSITE CABLE

[75] Inventor: Tetsufumi Ikeda, Kawasaki, Japan

[73] Assignee: Nippon Oil Co., Ltd., Japan

[21] Appl. No.: 434,349

[22] Filed: Nov. 13, 1989

[30] Foreign Application Priority Data

Nov. 10, 1988 [JP] Japan ..... 63-284222

[51] Int. Cl.[5] ..... D02G 3/00

[52] U.S. Cl. ..... 428/365; 428/367; 428/375; 428/377; 428/394; 428/395

[58] Field of Search ..... 57/232, 233, 234; 428/375, 377, 394, 395, 367, 365

[56] References Cited

U.S. PATENT DOCUMENTS 4,275,117 6/1981 Crandall ..... 57/234 X
4,312,260 1/1982 Morieras ..... 57/234 X
4,499,716 2/1985 Antal et al. ..... 57/234
4,534,163 8/1985 Schuerch ..... 57/234 X
4,677,818 7/1987 Honda ..... 57/297 X

*Primary Examiner*—Lorraine T. Kendell
*Attorney, Agent, or Firm*—Bruce L. Adams; Van C. Wilks

[57] ABSTRACT

A fiber-reinforced composite material is disclosed for use as a cable which comprises a master filament and a plurality of slave filaments disposed in surrounding relation thereto, both filaments being impregnated with a resin and thereafter coated by a knitted fiber web. The filaments are formed of a fibrous material of a selected class and have their respective tensile strength, elongation and moduli specified to achieve a desired cable quality.

10 Claims, 1 Drawing Sheet

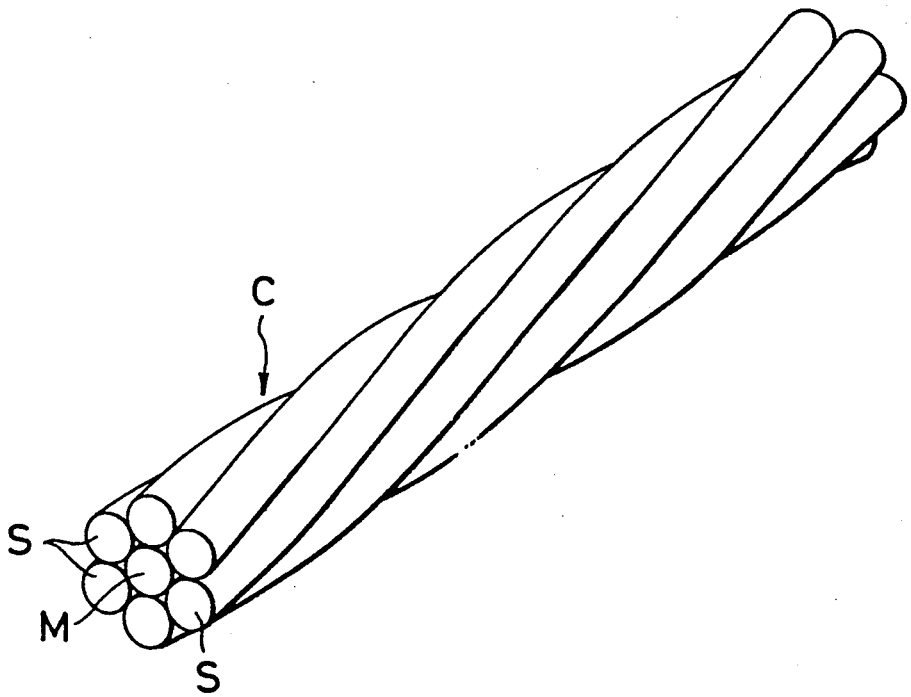
C
S
M
S

FIBER-REINFORCED COMPOSITE CABLE

BACKGROUND OF THE INVENTION

1. Field of the Invention

This invention relates to fiber-reinforced composite cables.

2. Prior Art

There have already been proposed certain fiber reinforced composite cables or cords in place of conventional steel cables which possess a tensile strength comparable to wire ropes, a smaller thermal expansion coefficient and a lighter weight such as those disclosed for example in Japanese Patent Publication No. 57-25679 and Laid-Open Publication No. 61-28092. Used as reinforcing fibers for such composite cables are glass fiber, aramid fiber and carbon fiber, of which high-strength carbon fiber is reputed for its excellent tensile properties. These reinforcing fibers in actual use have a tensile strength of the order of 300 kg/mm$^2$ and a tensile modulus of about 23 t/mm$^2$.

Quality requirements of late grow more and more strict for fiber-reinforced cables not only with respect to weight, corrosion resistance and thermal expansion, but also to tensile modulus exceeding that of steel. To achieve sufficient moduli with composite cables containing about 60 vol. % of reinforcing fibers, it would be necessary to use a fibrous material which has for itself a modulus of at least 35 t/mm$^2$ or somewhat greater than steel's modulus of about 20 t/mm$^2$. It would appear that good fiber-reinforced composite cables can be made available with such high tensile moduli. However, it has now been found that high modulus parameter alone fails to produce a truly satisfactory composite cable capable of demonstrating a full performance of reinforcing fibers per se as hereafter described.

SUMMARY OF THE INVENTION

It is the primary object of the present invention to provide a fiber-reinforced composite cable which has sufficient strength and high tensile modulus and which is capable of demonstrating a full performance of the reinforcing fiber used.

According to the invention, there is provided a fiber reinforced composite cable comprising a master filament and a plurality of slave filaments disposed in surrounding relation thereto, a synthetic resin impregnating the master and slave filaments and a knitted fiber web coating the impregnated master and slave filaments, the master filament being formed of a fiber having an elongation of 1.0–10% and a tensile strength of greater than 200 kg/mm$^2$ and the slave filaments being formed of a fiber having an elongation of less than 0.8% and a tensile modulus of greater than 35 t/mm$^2$.

BRIEF DESCRIPTION OF THE DRAWINGS

The accompanying drawing is a diagrammatic perspective view of a fiber-reinforced composite cable strand embodying the invention.

DETAILED DESCRIPTION OF THE INVENTION

A fiber-reinforced composite cable or cord of the invention is illustrated in the drawing to be in the form of a strand C comprising a linearly extending core or master filament M and a plurality of slave filaments S extending spirally in surrounding relation to the master filament M. The filaments M and S are obtained by impregnating their respective starting reinforcing fibers with a synthetic resin and thereafter coating the fibers with a fiber-knitted structure, followed by heat treatment thereof.

The synthetic resin used in the invention is thermosetting or thermoplastic. The thermosetting resin includes epoxy resin, unsaturated polyester, vinyl ester resin, phenol resin, furane resin, polyimide and the like. Most preferred of these resins is an epoxy resin of a bisphenol A or novolak type.

The thermoplastic resin includes polyamide, liquid crystal aromatic polyamide, polyester, liquid crystal aromatic polyester, polyethylene, polypropylene, polycarbonate, polysulfone, polyether sulfone, polyphenylene sulfide, polyether ketone, polyether ether ketone and the like, among which polyamide is particularly preferred.

Impregnation of the reinforcing fiber with the above resinous material can be effected by any suitable method using a solution or hot-melt procedure.

The fiber-knitted structure according to the invention is formed by knitting on an ordinary knitting machine any one of the group of fibers consisting of polyester, polyamide, polyacrylonitrile, polyvinyl alcohol, polyaramid and cellulose.

The composite structure of impregnated reinforcing fiber strand and knitted coating fiber is subjected to heat treatment at a temperature of preferably 120°–200° C. exceeding the hardening point of the thermosetting resin, or at a temperature of preferably 120°–350° C. exceeding the melting point of the thermoplastic resin, and subsequently cooled to harden.

The ratio of reinforcing fiber to resin is 40–70 vol. %, preferably 50–60 vol. %.

The ratio of knitted coating fiber to total cable mass is 2–20 wt. %, preferably 5–10 wt. %.

A high elongation, high strength fiber is used for the master filament M, which has an elongation of 1.0–10% and a tensile strength of above 200 kg/mm$^2$. The elongation of this fiber is preferably 1.0–5.0%, more preferably 1.0–2.0%. Elongation less than 1.0% would fail to maintain desired strength and modulus for the resulting composite cable.

No particular restriction is imposed on the tensile strength if greater than 200 kg/mm$^2$. It is usably in the range of 200–500 kg/mm$^2$, preferably 300–500 kg/mm$^2$. Tensile strengths of the reinforcing master filament M smaller than 200 kg/mm$^2$ cannot sustain the required strength and modulus of the resulting cable. Suitable materials for the master filament M are glass fiber, carbon fiber and aramid fiber, of which polyacrylonitrile-based carbon fiber is particularly preferred.

The slave filaments S surrounding the master filament M are formed of a high strength carbon fiber having an elongation of less than 0.8%, preferably 0.4–0.8%, more preferably 0.6–0.8%, and a modulus of greater than 35 t/mm$^2$, preferably 35–90 t/mm$^2$, more preferably 40–70 t/mm$^2$. Moduli less than 35 t/mm$^2$ are not conducive to the purpose of the invention. Pitch-based carbon fiber has been found particularly suitable for the slave filaments S.

The invention will be further described by way of the following examples which are however to be regarded as not limiting the invention thereto.

INVENTIVE EXAMPLE

Polyacrylnitrile carbon fiber having a tensile strength of 300 kg/mm$^2$ and an tensile modulus of 23 t/mm$^2$ was used for the master filament M. Pitch carbon fiber having a tensile strength of 300 kg/mm$^2$ and a tensile modulus of 41 t/mm$^2$ was used for the slave filaments S. These filaments M and S were impregnated with 100 parts by weight of epoxy resin (EPICOAT 828 of Shell Chemicals Co., Ltd.) and 3 parts by eight of $BF_3$ monoethylamine dissolved in acetone, and thereafter coated with a knitted web of polyester fiber. The whole was hardened at 200° C. for 40 minutes to produce a fiber-reinforced composite cable having a diameter of 5 mm. The reinforcing fiber contents were 60 vol. %. Polyester fiber coat was 8 wt. % based on the cable as a whole. The cable was tested for tensile strength according to ASTM D3916 with the results shown in the Table.

COMPARATIVE EXAMPLE 1

The procedure of Inventive Example was followed with the exception that polyacrylonitrile-based carbon fiber having a tensile strength of 300 kg/mm$^2$ and a modulus of 23 t/mm$^2$ was used as reinforcing fiber (for filaments M and S). Tensile strength test results are shown in the Table.

COMPARATIVE EXAMPLE 2

The procedure of Inventive Example was followed with the exception that pitch-based carbon fiber of 300 kg/mm$^2$ strength and 41 t/mm$^2$ modulus was used for the filaments M and S. Test results for tensile strength of the resulting cable are shown in the Table.

TABLE

| Composite Cable | tensile strength (kg/mm$^2$) | tensile modulus (t/mm$^2$) |
|---|---|---|
| Inventive Example | 170 | 23 |
| Comparative Example 1 | 170 | 13 |
| Comparative Example 2 | 130 | 18 |

What is claimed is:

1. A fiber reinforced composite cable comprising master filament and a plurality of slave filaments disposed in surrounding relation thereto, a synthetic resin impregnating said master and slave filaments and a knitted fiber web coating said impregnated master and slave filaments, said master filament being formed of a fiber having an elongation of 1.0–10% and a tensile strength of greater than 200 kg/mm$^2$, said slave filaments being formed of a fiber having an elongation of less than 0.8% and a tensile modulus of greater than 35 t/mm$^2$, said master filament extending as a linear core and said slave filaments extending spirally around said linear core.

2. A fiber reinforced composite cable according to claim 1 wherein said synthetic resin is a thermosetting resin selected from the group consisting of epoxy, unsaturated polyester, vinyl ester, phenol, furane and polyimide resins.

3. A fiber reinforced composite cable according to claim 1 wherein said synthetic resin is a thermoplastic resin selected from the group consisting of polyamide, liquid crystal aromatic polyamide, polyester, liquid crystal aromatic polyester, polyethylene, polypropylene, polycarbonate, polysulfone, polyether sulfone, polyphenylene sulfide, polyether ketone and polyether ether ketone resins.

4. A fiber reinforced composite cable according to claim 1 wherein said knitted fiber web is formed of a fiber selected from the group consisting of polyester, polyamide, polyacrylonitrile, polyvinyl alcohol, polyaramid and 5. A fiber reinforced composite cable according to claim 1 wherein said master filament is formed of polyacrylonitrile-based carbon fiber.

6. A fiber reinforced composite cable according to claim 1 wherein said slave filaments are formed of pitch-based carbon fiber.

7. A fiber reinforced composite cable according to claim 1 wherein the ratio of said knitted fiber web to total cable mass is 2–20 wt. %.

8. A fiber reinforced composite cable according to claim 1 wherein the ratio of said filaments to said resin is 40–70 vol. %.

9. A fiber-reinforced composite cable according to claim 1; wherein said master filament is formed of a fiber having an elongation of 1.0 to 2.0% and a tensile strength of 300–500 kg/mm$^2$.

10. A fiber-reinforced composite cable according to claim 1; wherein said slave filaments are formed of a fiber having an elongation of 0.6–0.8% and a modulus of 40–70 t/mm$^2$.

* * * * *